United States Patent [19]

Regan

[11] 4,433,939

[45] Feb. 28, 1984

[54] MARINE CONDUCTOR BENDING TOOL AND METHOD

[75] Inventor: Albert M. Regan, Huntington Beach, Calif.

[73] Assignee: Hughes Tool Company, Houston, Tex.

[21] Appl. No.: 297,533

[22] Filed: Aug. 31, 1981

[51] Int. Cl.[3] ..... E21B 7/12

[52] U.S. Cl. ..... 405/195; 72/370; 166/55; 166/342; 405/169

[58] Field of Search ..... 405/195, 168–171; 166/55, 297, 338–343, 345–349; 175/61, 73; 72/370, 369, 367; 285/24, 27, 39, 18; 29/237

[56] References Cited

U.S. PATENT DOCUMENTS

| | | | |
|---|---|---|---|
| 2,956,626 | 10/1960 | Hall | 175/61 X |
| 3,096,822 | 7/1963 | Hall | 166/55 X |
| 3,265,130 | 8/1966 | Watkins | 166/342 |
| 3,373,807 | 3/1968 | Fischer et al. | 166/342 |
| 3,903,974 | 9/1975 | Cullen | 72/370 X |
| 4,214,842 | 7/1980 | Franks | 166/341 X |
| 4,339,005 | 7/1982 | Schuh | 175/61 |

*Primary Examiner*—Dennis L. Taylor

*Attorney, Agent, or Firm*—Robert A. Felsman; Guy Porter Smith

[57] ABSTRACT

A subsea marine conductor bending tool for bending lower portions of the marine conductor when in the sea adjacent a subsea wellhead to align the conductor and its coupling member to a subsea wellhead has a plurality of individual bending beam assemblies and means for connecting them together in an articulated vertical array, a running tool for running the array of beam assemblies down within the conductor from an overhead platform to lower portions within the conductor adjacent a subsea location to which the conductor is to be aligned and hydraulically operated means on each of the bending beam assemblies operable from the overhead platform for applying bending forces against adjacent interior portions of the conductor to bend the same as required to align the conductor and its end connector to the wellhead. The bending tool is run down into the conduit, the conduit is bent into an S curve while in the subsea environment and landed into connection to the associated subsea wellhead while being bent by the bending tool, hydraulic fluid pressure used for causing the bending tool to bend the conduit is then relieved after landing of the connector on the wellhead and the tool is then withdrawn from the conductor.

13 Claims, 9 Drawing Figures

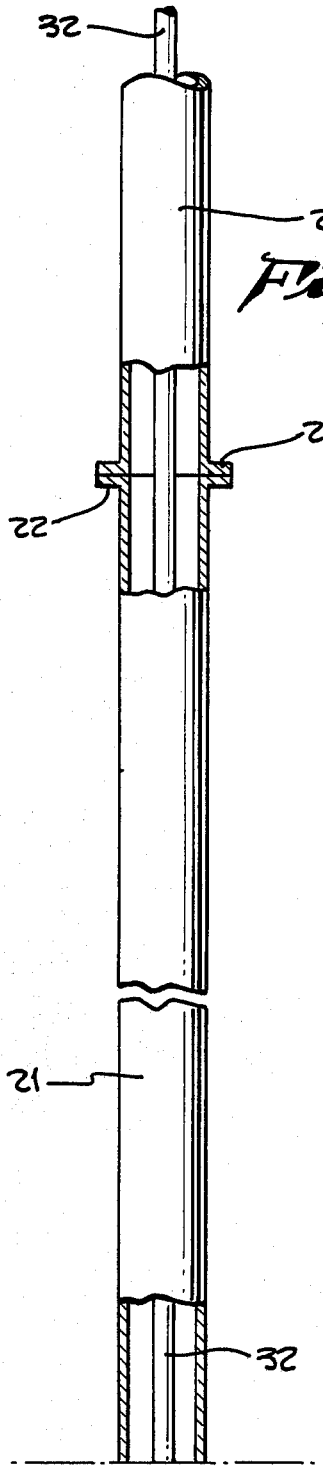
Fig. 8.a
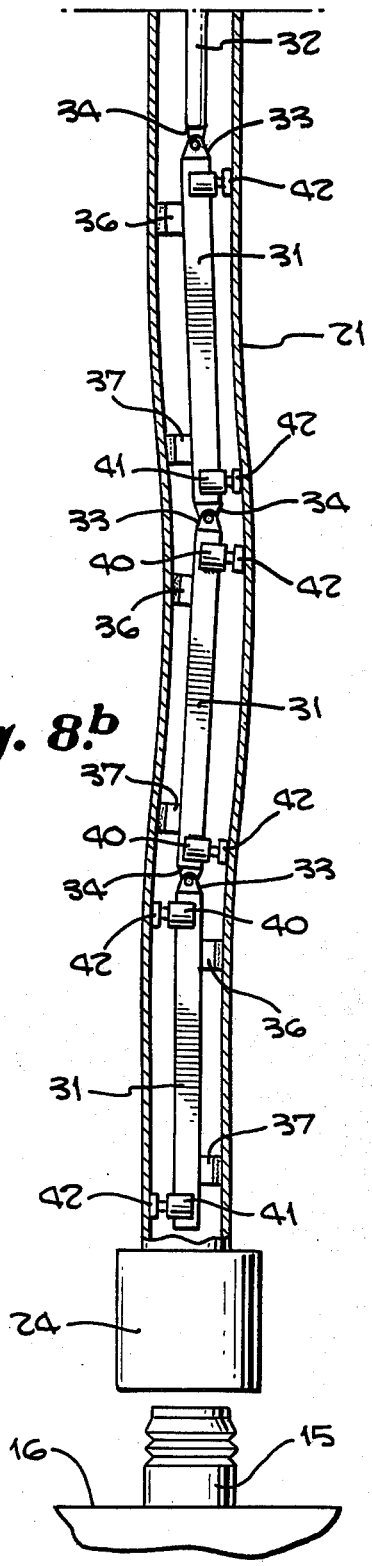
Fig. 8.b

MARINE CONDUCTOR BENDING TOOL AND METHOD

BACKGROUND OF THE INVENTION

This invention relates in general to subsea well installations and particularly to the establishment of a connection between a marine conductor run from an overhead platform to a subsea wellhead.

Various types of connectors have been developed heretofore for connecting a marine conductor or riser to a subsea wellhead, as the connector disclosed in prior U.S. Pat. No. 3,333,870. It has been known heretofore to run marine conductors and their associated marine connector by guidelines from floating vessels to the wellhead, or in shallower subsea well operations in run the conductor or riser from the overhead fixed platform down to the wellhead. A similar operation is conducted in tieback systems used after well drilling and completion stages. It has also been found that the marine conductor or conduit is not always conveniently aligned over the wellhead due to the buildup of tolerances in guiding mechanisms or the influence of ocean currents and/or winds on the vessel or platform. It has therefore been deemed to be desirable to be able to shift or move the lower end of the marine conductor or conduit in a determinable manner while in the subsea environment to align its associated marine connector to the wellhead to facilitate landing of the connector on the wellhead by further lowering of the marine conductor or conduit from the overhead platform or vessel.

In addition, in the directional drilling operations where a curved conductor pipe is to be used, it has been suggested that there is a need for a bending tool which could be inserted within the curved pipe to straighten it during the step of insertion of the conductor pipe through straight guides of the drilling platform. After the temporarily straightened conductor pipe is inserted through the straight guides of the platform the conductor pipe is allowed to reassume its curved configuration for conducting a directional drilling. It is an object of the present invention to disclose and provide a bending tool which may be used therefore in such a way that the tool can be inserted in the curved conductor pipe, hydraulic fluid applied to the tool to straighten the pipe temporarily during mounting to the platform guides ahd then be removed after relief of the hydraulic fluid pressure exerted on the tool, thus allowing the conductor to return to its original curved configuration. In this use for the bending tool of the present invention, the tool is employed to straighten a curved pipe for assembly of the pipe through guides. It is a primary object of the present invention to disclose and provide a method of curving an otherwise straight conductor in a subsea well location environment through the use of an internally operated bending tool to align an end of the conductor to the wellhead.

It is a further object of the present invention to disclose and provide a method of aligning the lower end of a marine conductor or conduit, even at great depths in the sea, over and adjacent a wellhead to which it is to be connected by operations from a remotely located overhead platform which may be fixed above the sea. It is contemplated within the present invention to provide a new marine conductor bending tool, and a new method of bending the marine conductor or marine conduit while it is suspended from an overhead platform or vessel and extending deeply into the sea by use of the bending tool in a new manner to achieve a new result in aligning and connecting marine conductor couplings to subsea wellheads located on the floor of the sea.

SUMMARY OF THE INVENTION

Generally stated, the method of aligning the lower end of a marine conductor and its associated marine conductor coupling to a subsea wellhead after the conductor and its connector have been run to a location in the sea adjacent the subsea wellhead by operations from an overhead platform comprise the steps of bending the lowermost portions of the otherwise straight marine conductor in a determinable curved manner to align the lower end of the conductor and its associated coupling to the adjacent wellhead and then landing the curved marine conductor and its associated connector on the wellhead by lowering the marine conductor while said lowermost portions are bent in said determinable curved manner. More specifically, the method of the present invention includes the substeps of applying one or more force couples by an appropriate bending tool assembly within the lower portions of the marine conductor by hydraulic fluid means to create a constant moment induced curve, which is preferably of an S configuration, in the lower portions of the conductor in a determinable manner so as to bring the conductor lower end and associated connector into a level, vertical alignment with the wellhead. The bending tool assembly is run down from the overhead platform or vessel within the conductor while it is suspended over the wellhead, hydraulic fluid under pressure is run from the overhead platform or vessel to the bending tool assembly to induce the desired conductor curvature, preferably an S curve, to move the conductor end and associated connector generally horizontally into alignment with the wellhead, these latter steps including the substeps of rotating the bending tool assembly within the conductor or conduit as needed and applying hydraulic fluid pressures until the desired curvature for the conductor is achieved to align the conductor end and associated connector, landing the conductor and its associated connector on the wellhead while the conductor lower portions are in the desired curved configuration, connecting the marine connector to the wellhead and then relieving the hydraulic fluid on the bending tool assembly and withdrawing the bending tool assembly from the landed and connected marine conductor.

Generally stated, the marine conductor bending tool of the present invention includes a plurality of bending beam units and means for connecting them together in an articulated array, a running tool for running the array of beam units down within the subsea conductor or conduit to be bent and hydraulically operated means of the bending beam units operable from the associated overhead platform for applying bending forces against adjacent interior portions of the conductor or conduit to bend the same as required to align the conductor or conduit to the wellhead. More specifically, each of the beam units comprises an assembly of a long beam and a pair of longitudinally spaced reaction pads on one side thereof and means at one or more ends thereof for providing a flexible connection to an adjacent beam end of the beam units. The hydraulically operated means of the beam units preferably comprises a pair of hydraulically operated jacks longitudinally spaced on each of the beams on a side thereof opposite to the reaction pads mounting and are spaced a greater distance apart than are the reaction pads in order to apply a force couple in a desired manner against the conductor or conduit within which the beams are located with hydraulic fluid supply means being run to each beam unit independently from the overhead platform.

It is believed that those skilled in the art will gain a better understanding of the present invention in method for aligning and coupling of a marine conductor to a subsea wellhead, as well as a recognition of additional advantages and objects thereof, from a consideration of the following detailed description of the method made in association with an exemplary embodiment of apparatus by which the method is exemplified. Reference will be made to the appended sheets of drawing which will first be briefly described.

BRIEF DESCRIPTION OF THE DRAWINGS

FIG. 8 is a vertical view of a marine conductor or conduit being bent into an S curve by the method and apparatus of the present invention to shift the connector generally horizontally into vertical alignment with the method.

DETAILED DESCRIPTION OF AN EXEMPLARY EMBODIMENT

Figure 1:
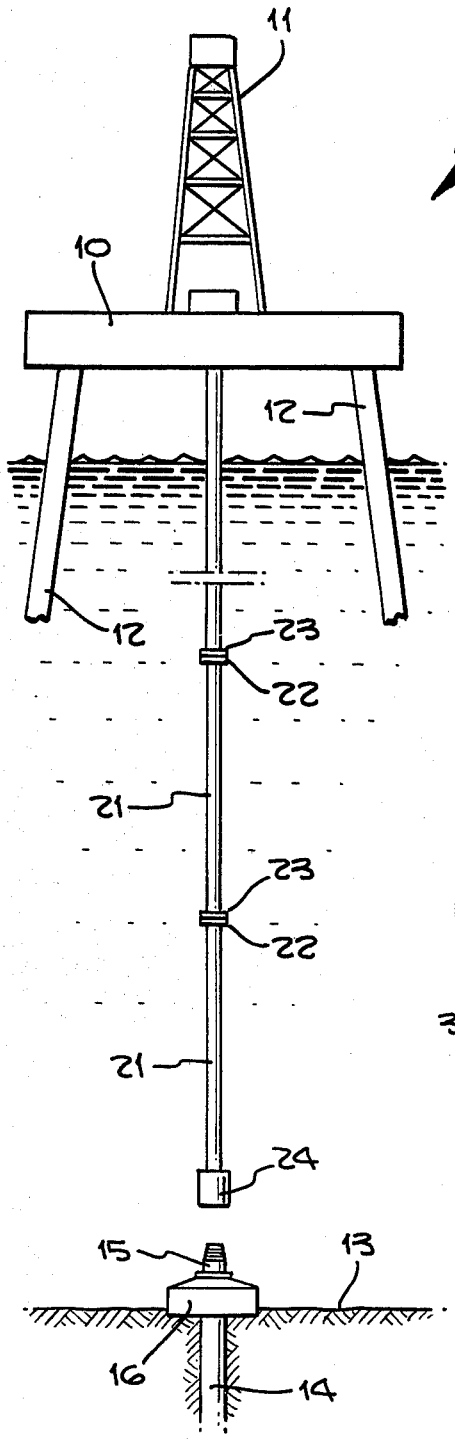
FIG. 1 is a somewhat schematic elevational view of a subsea well installation wherein a marine conductor or conduit coupling is being lowered from an overhead platform to connect to a subsea wellhead, an environment in which the method of the present invention for aligning the marine conductor to the wellhead finds particularly suitable use.

Referring now initially to FIG. 1, an exemplary environment is illustrated in which the bending tool apparatus and method for aligning subsea conduits, according to the present invention, finds particularly suitable use. A stationary platform 10 mounts a conventional derrick 11 via its platform legs 12 which support the platform from the sea bottom 13 over a subsea well casing 14 and the wellhead 15 situated within a conventional template 16. In order to initiate drilling operations or to tie in to a completed well, a subsea marine conductor or conduit 20 is run from the overhead platform, to the wellhead 15 with drilling operations being conducted in known manner through the conductor. Conductor 20 is formed of a plurality of conduit sections 21, each having upper and lower flanges, as upper flanges 22 and lower flanges 23, the plurality of sections being assembled on the platform in association with derrick 11 and being run down to the wellhead with a connector 24, which may be made in accordance with U.S. Pat. No. 3,333,874 by way of example, to connect the conductor to the wellhead. While the platform can be stationed with some accuracy over the wellhead, and the connector run on guides to the well template, the connector 24 is not always readily alignable to the wellhead 15 on lowering of the marine conductor to the wellhead, a typical misalignment being illustrated in FIG. 2.

Figure 2:
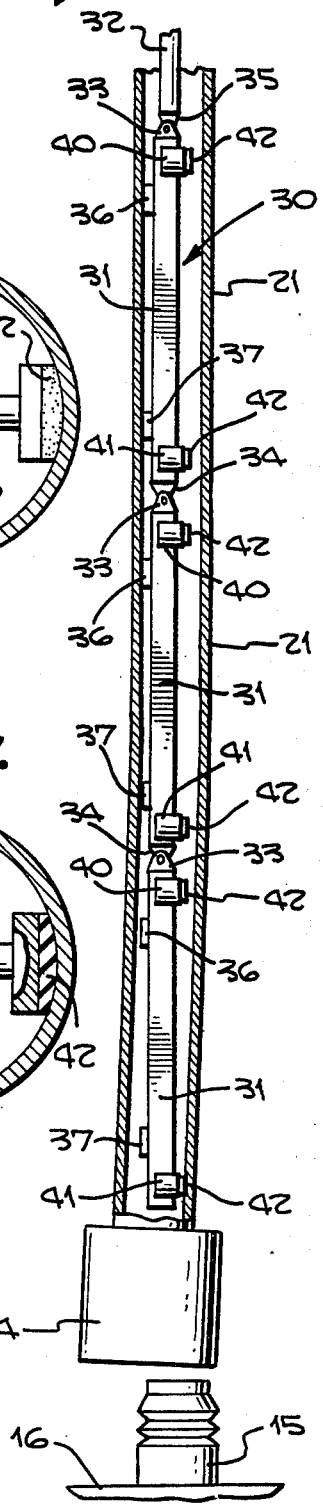
FIG. 2 is a vertical view, partially in section, of the lowermost sections of the marine conductor of FIG. 1 showing an exemplary embodiment of marine conductor bending tool in accordance with the method of the present invention lowered within the conductor section adjacent the lower end thereof.
Figure 3:
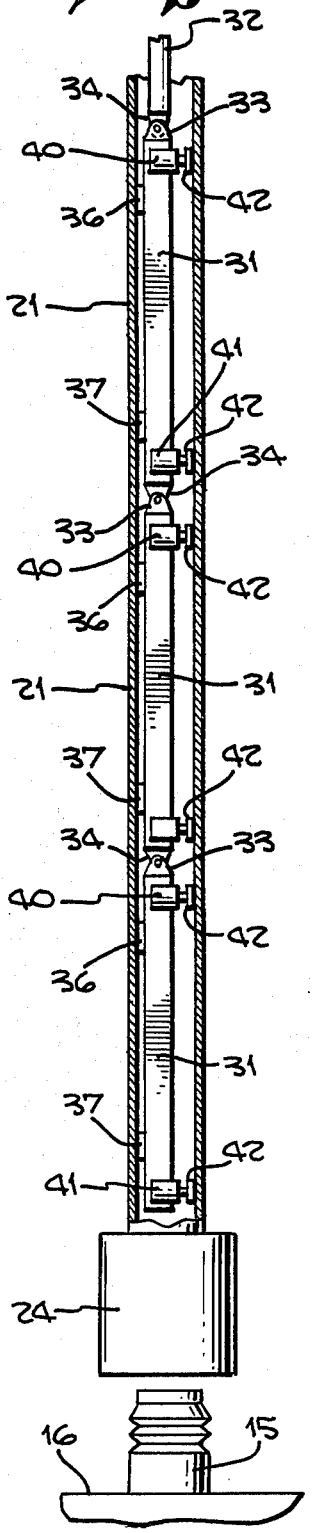
FIG. 3 is a detailed view as in FIG. 2 showing the aligning of the lowermost sections of the marine conductor to the wellhead by the method of the present invention.

When the marine conductor 20, and its sections 21 have been run to place the connector 24 adjacent the wellhead 15, as illustrated in FIG. 2, it is contemplated within the present invention to bend the lowermost sections of the normally straight marine conductor 20 in a determinable curved manner in order to align connector 24 to wellhead 15 as seen in FIG. 3. An exemplary embodiment of the apparatus of the present invention will now be described in association with the description of the method for aligning the lowermost ends of conductor 20 to an associated conduit, such as wellhead 15 according to the present invention.

Figure 6:
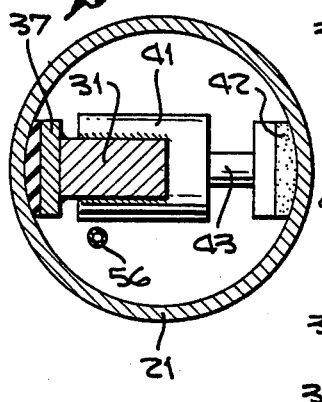
FIG. 6 is a horizontal section view of the conductor and bending tool of FIG. 5 taken therein along the plane VI—VI.

The exemplary subsea marine conductor bending tool is illustrated being lowered into marine conductor 20 in FIG. 2 and comprises an assembly of beam units, indicated generally at 30, which includes an articulated array of long beams or beam units 31 run by a running tool 33 down into the conductor. Beam units 31 are preferably about twenty feet in length so that an array of three or more beam units will extend a substantial distance within one of the conduit sections 21 of the marine conductor such sections generally being about two hundred feet in length. Each of the beam units are connected by end fittings which are pivotally connected to each other, each of the beam units having an upper end fitting 33 and a lower end fitting 34, the running tool 32 having a mating bottom end fitting 35. The end fittings may comprise apertured flanges which overlap with appropriate fasteners, such as bolts, passing through the flanges to allow a flexible, articulated movement between the beam units 31 when suspended from the running tool 32. Each of the beam units 31 is further provided with a top reaction pad 36 and a bottom reaction pad 37 on the same side of the tool in order that the two pads face in the same direction. As seen in the detailed view of FIG. 6, each of the reaction pads 37 may be provided with a metallic base welded directly to the individual beams of each beam unit 31 with a more resilient facing pad 38 adapted to conform to the inner curvature of the conduit section 21.

Figure 7:
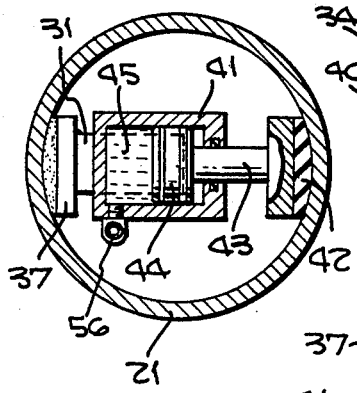
FIG. 7 is a horizontal section view of the marine conductor and exemplary bending tool of FIG. 5 taken therein along the plane VII—VII.

Hydraulically operated means are provided on the bending beam units 31 with such hydraulic means being operable from the overhead platform to apply bending forces against adjacent interior portions of the conductor to bend the same as required to align the conductor lower end to the wellhead. In the exemplary embodiment, such hydraulically operated means includes the provision of a pair of hydraulic jacks 40 and 41, respectively, longitudinally spaced on the beam unit on a side thereof opposite to the side on which the reaction pads 36 and 37 are located. Hydraulic jacks 40 and 41 are more widely spaced on the beam unit than are the reaction pads so that on operation of the jacks, each beam unit and its associated jacks and reaction pads will apply a pair of force couples on adjacent portions of the conductor to bend the same in a constant moment induced curve. As seen in detail in FIGS. 6 and 7, each of the hydraulic jacks 40 and 41 on each of the beam units 31 is provided with a pad 42 mounted on an associated piston rod 43 operated by a piston 44 within the hydraulic cylinder 45. Pad 44 may have a metallic base connected to the piston rod 43 with a more resilient facing pad adapted to conform to the interior portions of the conductor.

Figure 5:
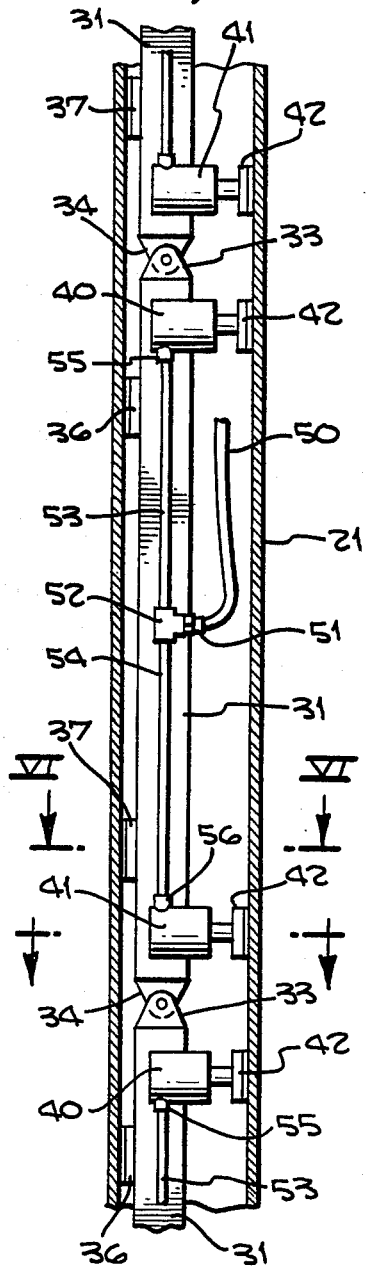
FIG. 5 is a detailed view, partially in section, of the exemplary embodiment of bending tool of FIGS. 2 through 4.

Hydraulic fluid supply means are run from the overhead platform to the hydraulically operated jacks 40 and 41 of each of the beams, in the exemplary embodiment, to individually operate the hydraulic jacks 40 and 41 of each individual beam units 31 of the vertical array. The bending moment of each beam applied within the conductor is thus individually controllable by applying hydraulic fluid as desired to the hydraulic jacks of that particular beam. Exemplary thereof is the hydraulic fluid supply line 50 connected by fitting 51 to a Tee member 52 and flow lines 53 and 54 to the hydraulic jacks 40 and 41 of the center beam unit 31 shown in detail in FIG. 5. Similar hydraulic lines are provided for the upper beam unit 31 and the lower beam unit 31 in the detailed view of FIG. 5 which are individually operated from the overhead platform.

Figure 4:
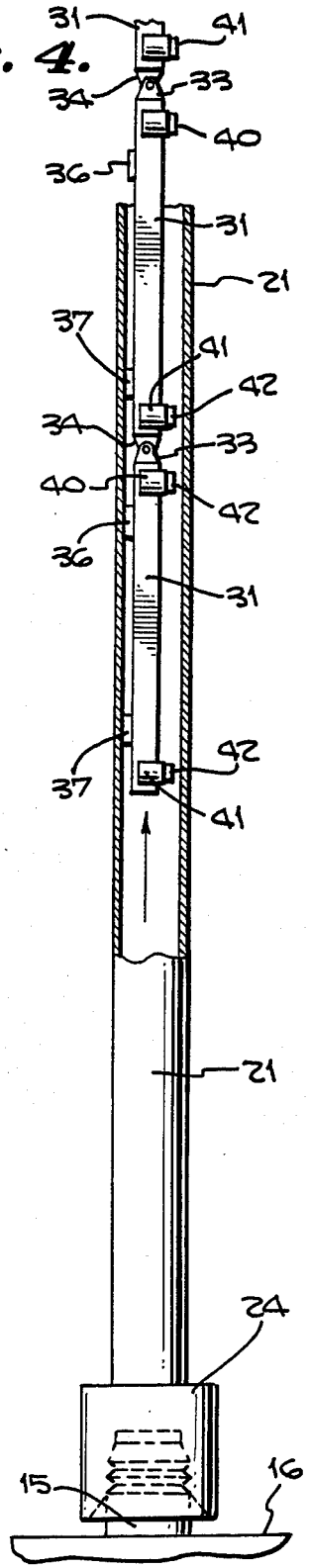
FIG. 4 is a detailed view as in FIG. 3 showing the exemplary bending tool being removed from the conductor which has been landed on the wellhead while aligned thereto by the bending tool in accordance with the method of the present invention.

The method of the present invention for aligning a marine conductor or conduit to another marine conduit, such as the marine conductor or a tie back conduit to the wellhead, and as can be seen from the foregoing description, includes the running of a vertical array of bending tool units from an overhead platform down within the marine conductor when it is positioned in the sea with the lower end of the conductor adjacent the subsea conduit or casing to which it is to be aligned, the wellhead in the exemplary embodiment. The lowermost sections of the marine conductor are bendable in a determinable manner by aligning the vertical array of bending tools by rotating them about their vertical axis in order to place the vertically aligned jacks 40 and 41 and the similarly vertically aligned reaction pads 36 and 37 facing oppositely of jacks 40 and 41 in a determinable direction in order to exert bending forces within the conductor in a direction to overcome the conduit misalignment. As seen in FIG. 8, the marine conduit may be beat into an S curve by the tool and method of the present invention when the lower beam unit is faced a direction opposite the upper units in order to shift the connector 24 generally horizontally in a level attitude until it is vertically aligned over the wellhead. The running of the bending tool is illustrated in FIG. 2 with the tool bending the lower portions of the conductor into a wellhead aligned mode in FIGS. 3 and 8. When the conductor is so aligned, it may be lowered via the platform derrick from which the conduit or conductor 20 is suspended to land the same, and the connector 20, or the wellhead 15 as seen from a comparison of FIGS. 3 and 4. The hydraulic fluid applied from the platform to actuate the hydraulic jacks may then be relieved and the tool removed from the aligned and connected conductor 20 as seen in FIG. 4. Each of the beam, hydraulic jack and reaction pad assemblies apply a force couple against the beam with a plurality of such force couples being applied, determined by the number of beams, the direction the beam face and the amount of hydraulic employed. A permanent bend may be applied to the conduit so that there is a reduced residual stress in the completed connection.

While the exemplary bending tool emplys three beam, hydraulic jack and reaction pad assemblies, with each being individually supplied by hydraulic fluid, it is believed that lesser or greater numbers of such assemblies could be employed with the use of a common hydraulic fluid supply within the scope of the present invention. In addition, while in the exemplary embodiment the lowermost portions of the conduit sections 21 were being bent by the exemplary bending tool, it is believed that the bending tool could be applied in a single conduit section or conductor in other situations to bend it as required to straighten, bend or align the end of the casing or conduit being bent in the environment of the sea. It is believed that those skilled in the art will appreciate that the various advantages and objects stated for the present invention hereinbefore have been attained by the exemplary embodiment of marine conductor coupling bending tool and method described herein and that various modifications, adaptations and alterations thereof may be made within the scope of the present invention which is defined by the following claims.

I claim:

1. A method of aligning a marine conduit coupling to a subsea wellhead at the wellhead after the connector is run on the end of the marine conduit to adjacent the subsea wellhead from an overhead platform comprising the steps of:

bending a permanent bend in the lowermost portions of the marine conduit in a determinable manner to align the coupling to the wellhead it is adjacent; and landing the marine conduit on said wellhead by lowering said conduit while said lowermost portions are bent in said determinable manner.

2. A method of aligning a marine conduit coupling to a subsea wellhead at the wellhead after the connector is run on the end of the marine conduit to adjacent the subsea wellhead from an overhead platform in a misaligned condition comprising the steps of:

bending the lowermost portions of the marine conduit in a determinable manner by applyihg forces in one or more force couples within said conduit to apply a constant moment induced curve to said lowermost portions of said conduit to align the coupling to the wellhead it is adjacent; and landing the marine conductor on said wellhead by lowering said marine conductor while said lowermost portions are bent in said determinable manner wherein said step of bending portions of said conduit includes the substep of applying a permanent bend to the conduit to reduce residual stress after completion of the connection.

3. A method of aligning a marine conduit coupling to a subsea wellhead at the wellhead after the connector is run on the end of the marine conduit to adjacent the subsea wellhead from an overhead platform comprising the steps of:

running a bending tool from said platform down within said conduit to within said conductor lowermost portions;

applying hydraulic fluid under pressure from said platform to said tool when the latter is located within said conduit;

bending the lowermost portions of the marine conduit in a determinable manner from therewithin to align the coupling to the wellhead it is adjacent; and landing the marine conduit on said wellhead by lowering said conduit while said lowermost portions are bent in said determinable manner.

4. A method of aligning a marine conductor conduit to a subsea wellhead at the wellhead after the connector is run on the end of the marine conduit to adjacent the subsea wellhead from an overhead platform comprising the steps of:

providing a bending tool to bend in a given direction normal to its vertical axis in response to application of hydraulic fluid thereto;

running said bending tool from said platform down within said conductor to within said conductor lowermost portions;

rotating said tool about its axis within said conduit portions to orient said tool for said bending of said portions;

bending the lowermost portions of the marine conduit in a determinable manner by applying forces in one or more force couples within said conduit to apply a constant moment induced curve to said lowermost portions of said conductor to align the coupling to the wellhead it is adjacent; and landing the marine conduit on said wellhead by lowering said conduit while said lowermost portions are bent in said determinable manner.

5. The method of claims 3 or 4 wherein said bending tool includes a plurality of articulated beam units suspended from a lowering tool, each beam unit having a pair of like facing hydraulic jacks on one side thereof and a pair of like facing reaction pads on an opposite side thereof and wherein said step of applying hydraulic fluid under pressure from said platform to said tool includes the substep of actuating said jacks of each beam unit against interior portions of said conduit portions with said oppositely facing reaction pads being against opposite interior portions of said conduit sections.

6. A method of aligning a marine conductor coupling to a subsea wellhead at the wellhead after the connector is run on the end of the marine conductor to adjacent the subsea wellhead from an overhead platform comprising the steps of:

bending portions of the marine conductor into an S curve in a determinable manner with the lower end and the upper portions of the marine conductor being straight and separated by the curve to align the coupling to the wellhead it is adjacent; and landing the marine conductor on said wellhead by lowering said marine conductor while said portions are bent in said S curve.

7. A method of aligning a marine conductor coupling to a subsea wellhead at the wellhead after the connector is run on the end of the marine conductor to adjacent the subsea wellhead from an overhead platform comprising the steps of:

bending portions of the marine conductor into an S curve in a determinable manner to align the coupling to the wellhead it is adjacent; and landing the marine conductor on said wellhead by lowering said marine conductor while said portions are bent in said S curve; and wherein said step of bending portions of the marine conductor comprises the substeps of;

applying forces in one or more force couples within the lower portions of said conductor to apply a constant moment induced S curve to said portions of said conductor.

8. The method of claim 7 comprising the additional steps of:

running a bending tool from said platform down within said conductor lower portions;

applying hydraulic fluid under pressure from said platform to said tool when the latter is located within said conductor; and performing said bending of said conductor from therewithin by applying hydraulic pressure to said tool to bend said conductor until said connector is moved generally horizontally to be vertically aligned to said wellhead.

9. The method of claim 8 wherein said bending tool is provided to bending in given directions normal to its vertical axis in response to application of hydraulic fluid thereto and said step of running said tool to within said conductor lower portions includes the substep of rotating said tool about its axis within said conductor to orient said tool for said bending of said portions.

10. A marine conductor bending tool for use from an abovesea platform for bending lower portions of a marine conductor when in the sea with lower conductor portions being adjacent a wellhead to align the conductor lower portions to the wellhead comprising:

a plurality of bending beam units and means for connecting them together in an articulated array;

a running unit for running said array of beam units down within said conductor to a subsea conductor location within said conductor from an overhead platform; and hydraulically operated means on said bending beam units operable from said platform for applying bending forces against adjacent interior portions of said conductor to bend the same as required to align said conductor to said wellhead.

11. A marine conductor bending tool for use from an abovesea platform for bending lower portions of a marine conduit when in the sea, comprising:

a plurality of bending beam units and means for connecting them together in an articulated array, each of said bending units comprising a beam with a pair of longitudinally spaced reaction pads on one side thereof and a pair of hydraulically operated jacks longitudinally spaced on each of said units on an opposite side thereof; and hydraulically operated power means operable from the platform for supplying hydraulic fluid independently to the hydraulic jacks of each beam for selectively applying bending forces against adjacent interior portions of said conductor to bend the same as desired.

12. A subsea marine conductor bending tool for use from an abovesea platform for bending lower portions of a marine conductor when in the sea with lower conductor portions being adjacent a wellhead to align the conductor lower portions to the wellhead comprising:

a plurality of bending beam units and means for connecting them together in an articulated array wherein each of said bending units comprises a pair of hydraulically operated jacks longitudinally spaced on each of said units on one side thereof and a pair of reaction pads longitudinally spaced a lesser distance apart on each of said units on an opposite side thereof;

a running unit for running said array of beam units down within said conductor to a subsea location within said conductor from an overhead platform; and hydraulically operated power means operable from said platform for supplying hydraulic fluid pressure to the jacks for applying bending forces against adjacent interior portions of said conductor to bend the same as required to align said conductor to said wellhead.

13. A subsea marine conductor bending tool for use from an abovesea platform for bending lower portions of a marine conductor when in the sea with lower conductor portions being adjacent a wellhead to align the conductor lower portions to the wellhead comprising:

a plurality of bending beam units and means for connecting them together in an articulated array wherein each of said bending units comprises:

a pair of hydraulically operated jacks longitudinally spaced on each of said units on one side thereof and a pair of reaction pads longitudinally spaced a lesser distance apart on each of said units on an opposite side thereof;

a running unit for running said array of beam units down within said conductor to a subsea location within said conductor from an overhead platform with at least two of said units facing in opposite directions; and hydraulically operated power means operable from said platform for supplying hydraulic fluid pressure to the jacks for applying bending forces against adjacent interior portions of said conductor to bend the same into an S configured curve to align said conductor to said wellhead.

* * * * *